US005720146A

United States Patent [19]

Arnold et al.

[11] Patent Number: 5,720,146

[45] Date of Patent: Feb. 24, 1998

[54] PROCESS AND APPARATUS FOR SEALING DOUBLEWIDE MANUFACTURED AND MODULAR HOMES

[76] Inventors: Gregory A. Arnold; Jamie C. Arnold, both of 306 Pine St., Auburndale, Fla. 33823

[21] Appl. No.: 684,997

[22] Filed: Jul. 22, 1996

[51] Int. Cl.[6] ..... E04B 1/68

[52] U.S. Cl. ..... 52/741.4; 52/79.9

[58] Field of Search ..... 52/741.4, 79.9, 52/64, 309.4; 49/475.1

[56] References Cited

U.S. PATENT DOCUMENTS

| | | | |
|---|---|---|---|
| 1,742,195 | 1/1930 | Bosely | 49/475.1 |
| 2,827,280 | 3/1958 | Burkhalter . | |
| 2,899,237 | 8/1959 | Nash | 52/64 X |
| 3,170,967 | 2/1965 | Williams et al. . | |
| 3,413,389 | 11/1968 | Footner . | |
| 3,881,283 | 5/1975 | Pender . | |
| 4,084,348 | 4/1978 | Hast . | |
| 4,622,787 | 11/1986 | Scott | 52/58 |
| 5,353,558 | 10/1994 | Shea et al. | 52/143 |

*Primary Examiner*—Robert Canfield

*Attorney, Agent, or Firm*—William M. Hobby, III

[57] ABSTRACT

A process for sealing doublewide manufactured homes includes the steps of selecting an elongated polymer sealing material, such as a polyurethane foam, wrapped in a flexible material, such as a woven polypropylene. The flexible material is attached around the foamed polymer and has an elongated flange. The selected sealing material is cut to a desired length and attached around the perimeter of one side of a doublewide manufactured home section. A pair of manufactured home doublewide sections are attached together with the seal attached to the perimeter of one section to seal between the doublewide sections when the sections are attached together to form a doublewide manufactured home. The sealing material has the flexible polypropylene wrapped around the foamed polyurethane and one edge thereof folded over the other edge and sewn together to form a flange. The material is square in cross-section and the polyurethane is at least one and one half inch thick.

6 Claims, 1 Drawing Sheet

PROCESS AND APPARATUS FOR SEALING DOUBLEWIDE MANUFACTURED AND MODULAR HOMES

BACKGROUND OF THE INVENTION

The present invention relates to a process for sealing doublewide manufactured homes and modular homes sections together and especially to a process using a sealing material having a thick foamed polymer material wrapped in a flexible polymer material.

Manufactured homes are those in which a home or building is manufactured at a central location or factory where it can then be loaded onto a tractor-trailer and hauled to a purchaser's home site. At the home site, the manufactured home can be mounted onto a prepared foundation. Manufactured homes, in contrast to custom homes, have the advantages of mass production at one factory site where they can obtain the benefits of volume purchasing, more efficient assembly through standard jigs, fixtures, and machinery, and can have a more advanced engineering design. One of the problems with manufactured homes has been in making a home of a size and shape that can be hauled over a highway. This limits the width of the home and thus limited the homes to smaller elongated units. To overcome this limitation, double wide manufactured homes were developed which use a pair of manufactured home sections, each of which can be the same size as one manufactured home but without one wall so that doublewide manufactured home sections can be individually hauled to a home site where the two sections can be brought together and attached to form a manufactured home which does not have the customary elongated shape of a typical manufactured home. This allows for larger homes which can have additional design features to make the home look more like a custom home.

In recent years, doublewides have become increasingly popular but have also had various problems attached with them including the proper attachment of the doublewide sections together to form one unit which attachments must appear seamless and at the same time need to be well sealed from the exterior weather elements. Common doublewides today are attached together and are caulked around the perimeter of the attaching line or, alternatively, are shot with an expanding polymer caulk to seal the perimeter. One of the difficulties in sealing a pair of doublewides is that the seam around the attached sections tends to vary in width on the outside so that conventional caulk is not always satisfactory and expanding foam tends to weather and does not always give a weatherproof seal.

The present invention improves the sealing in doublewide manufactured homes along the perimeter of the attached sections which not only gives a good seal against the weathering elements but also will not deteriorate in the manner of other materials currently being used.

Prior art sealing strips for forming a variety of seals, but not seals for manufactured home doublewides, can be seen in the U.S. Pat. to Hast, No. 4,084,348, for a sealing strip which has a cylindrical shape having a resilient core of foamed plastic surrounded by a foil of PVC or polyethylene and an outer covering of textile fabric and in which the outer covering and the foil are attached together to form a flange which also has an adhesive strip attached thereto. The L. N. Williams et al. U.S. Pat. No. 3,170,967, and R. A. Footnet U.S. Pat. No. 3,413,389, each teach a method of making a sealing strip using a polyvinyl foam having a polyvinyl resin skin outer layer. In the Burkhalter U.S. Pat. No. 2,827,280, a resilient bumper is made of a cylindrical rubber resilient core having a tubular sheath closure and which are attached together with a grommet therebetween. These prior art seals are not suitable for use in sealing doublewide sections which requires a much thicker sealing strip with greater flexibility and with a more flexible cover in order to be able to give a seal with wide variations in the spacing between the doublewide sections at different points around the perimeter of the assembled doublewide home.

It is accordingly an object of the present invention to provide a process of sealing doublewide manufactured home sections together with a selected sealing material custom formed for sealing doublewides which can be rapidly attached to one section of the doublewide before the doublewide sections are attached together. A polyurethane polymer of approximately 1.2 density is enclosed with a woven polypropylene which is attached with one edge folded over the other and sewn together to form the flange with one sewing strip giving greater strength to the flange.

SUMMARY OF THE INVENTION

A process for sealing doublewide manufactured homes includes the steps of selecting an elongated polymer sealing material, such as a polyurethane foam, wrapped in a flexible material, such as a woven polypropylene. The flexible material is attached around the foamed polymer and has an elongated flange. The selected sealing material is cut to a desired length and attached around the perimeter of one side of a doublewide manufactured home section. A pair of manufactured home doublewide sections are attached together with the seal attached to the perimeter of one section to seal between the doublewide sections when the sections are attached together to form a doublewide manufactured home. The sealing material has the flexible polypropylene wrapped around the foamed polyurethane and one edge thereof folded over the other edge and sewn together to form a flange. The material is square in cross-section and the polyurethane is at least one and one half inch thick.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
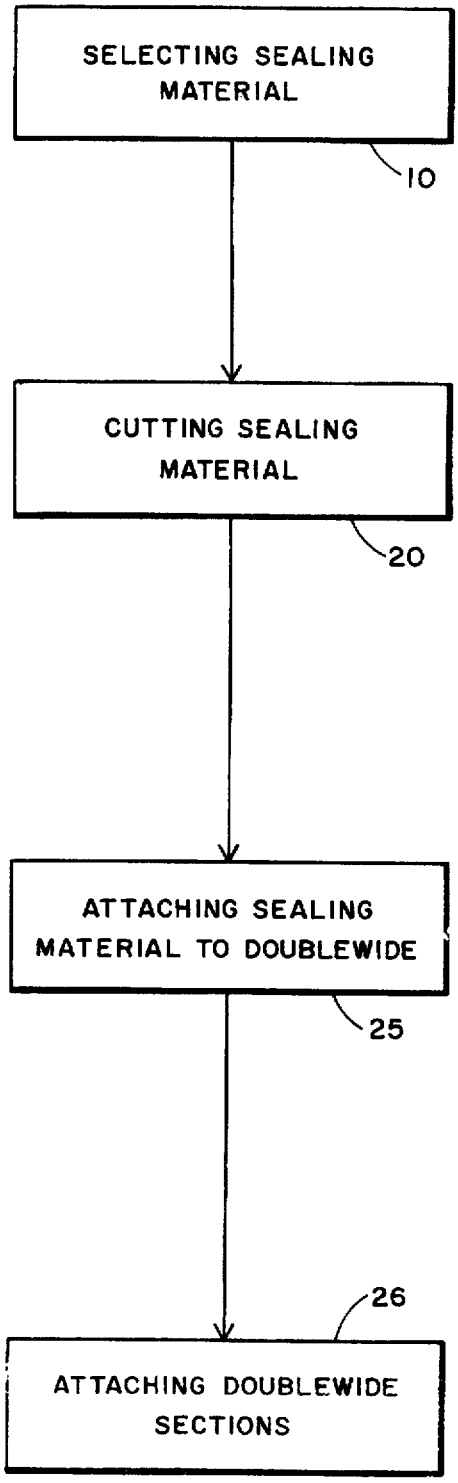
FIG. 1 is a flow diagram of a process of attaching doublewide manufactured home sections in accordance with the present invention.
Figure 2:
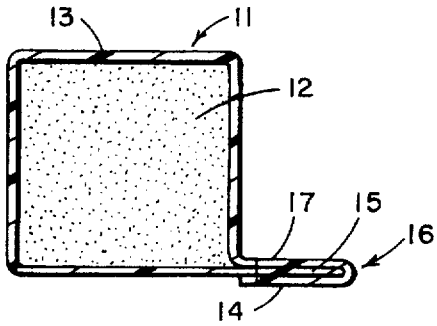
FIG. 2 is a sectional view taken through the sealing material used in the present invention.

Referring to the drawings, FIGS. 1–5, a process of sealing a pair of doublewide manufactured home sections together is illustrated in which the first step is selecting the sealing material 10 of FIG. 1. The selected material 11, as shown in FIG. 2, has a foamed polymer, such as polyurethane, having great flexibility in conforming to a sealing shape. In FIG. 2, the cross-section shows that the foamed polymer 12 has an approximately square shape and has a cover 13 wrapped therearound. The cover is made of a woven polypropylene, which may have an ultraviolet blocking material incorporated therein. The woven polypropylene has the advantages of being a very flexible material resistant to weathering elements and not subject to the break-up that might result to the polyurethane foam 12. In addition, it can be sewn together and provides the needed flexibility since the cover 13 is not attached to the foam 12 but is merely wrapped therearound with the edges attached together.

Figure 3:
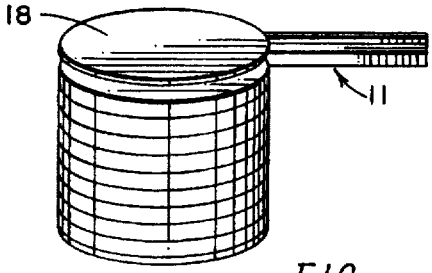
FIG. 3 is a perspective view of a roll of sealing material having the end being rolled off of a spool for measuring and cutting.

As seen in FIG. 2, one folded edge 14 of the material 13 has a second folded edge and has been folded over and around the two edges 15 of the material 13, after being wrapped around the foamed polyurethane core 12. The attachment of the flexible wrapping material in this manner provides a flange 16 having four layers of woven polypropylene covering material which is sewn with the stitches 17 through the four layers which thereby seals the material around the foamed polymer core 12 and holds the flange together with one stitched line located adjacent the foamed core material 12. This material can advantageously be prepared in large or smaller quantities and can then be packaged on large spools or drums 18, as shown in FIG. 3, where the material 11 can be reeled off the drum 18 where it can be measured and cut in accordance with the step 20 of the process of FIG. 1.

Figure 4:
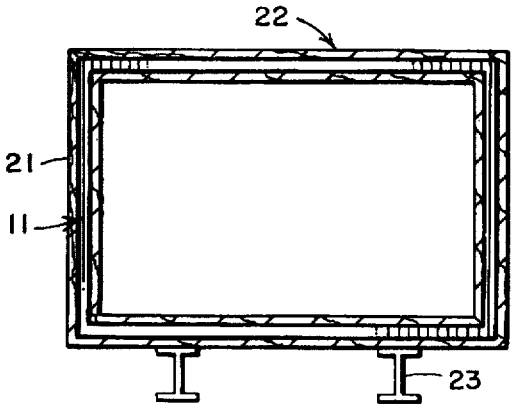
FIG. 4 is a side elevation of a doublewide manufacturing home section having the present sealing material attached thereto.
Figure 5:
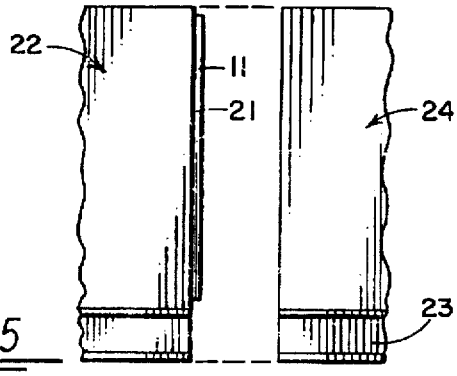
FIG. 5 is a partial side elevation of a pair of doublewide sections being brought together.

Once the material is cut from the spool 18, the flange 16 can be stapled through the four layers of the flange to the attaching wall section 21 of a doublewide manufactured home section 22, which is shown in FIG. 4 supported on a pair of I-beams 23. The sealing strip 11 is attached around the perimeter of the doublewide section 22 so that when a pair of doublewide sections 22 and 24 are attached with the sealing material therebetween.

The doublewide sections 22 and 24 are brought together while supported on an I-beam 23 and are attached together to form one doublewide manufactured home. The attachment of the sealing material strip 25 to the doublewide section can be accomplished in any way desired but powered staplers provide a convenient means and, because of the strength of the woven polypropylene formed in six layers in the flange, a secure attachment can be accomplished.

The seal can be attached at the factory or on site during the assembly of the doublewide sections 22 and 24 where the seals are conventionally added to the doublewide sections. The attaching of the doublewide sections strip 26 can be rapidly accomplished and because of the thickness of the foamed polyurethane 12 forming the sealing material and because of the amount of air incorporated into the polyurethane. The polyurethane can be compressed and expanded with great flexibility over wide variations in the sealing gap. The polyurethane foamed material may be of a thickness of one inch or greater. The seal tends to seal any space between the doublewide sections from a very tight fit up to a one and one half inch space to thereby tightly seal between the doublewide sections to prevent the intrusion of weather elements as well as to block the ingress of insects or the like.

It should be clear at this time that a process for sealing a doublewide manufactured home sections together has been provided along with a sealing material specifically made for sealing doublewides together. However, it should also be clear that the present invention is not to be limited to the forms shown which are to be considered illustrative rather than restrictive.

I claim:

1. A process for sealing doublewide manufactured homes comprising the steps of:

selecting a sealing material having elongated polymer foam wrapped in flexible material which flexible material forms a flange therealong;

cutting a length of said selected sealing material;

attaching said cut selected material around the perimeter of one attaching side of a doublewide manufactured home using said selected material flange for driving fasteners therethrough and into said one attaching side of a doublewide; and attaching a pair of mobile home doublewide sections together having said selected sealing material sealing the perimeter between the doublewide sections.

2. A process for sealing doublewide manufactured homes in accordance with claim 1 in which the step of selecting elongated sealing material includes selecting an elongated polymer foam at least one and one half inch thick.

3. A process for sealing doublewide manufactured homes in accordance with claim 2 in which the step of selecting elongated sealing material includes selecting an elongated sealing material having an elongated polymer foam having a cover of flexible polypropylene.

4. A process for sealing doublewide manufactured homes in accordance with claim 2 in which the step of selecting elongated sealing material includes selecting an elongated sealing material having an elongated polymer foam having a cover of flexible woven polypropylene.

5. A process for sealing doublewide manufactured homes in accordance with claim 2 in which the step of selecting elongated sealing material includes selecting an elongated sealing material having an elongated polymer foam having a cover of flexible polypropylene having an elongated stapling flange formed therewith and said flange having four layers of elongated sealing material.

6. A process for sealing doublewide manufactured homes in accordance with claim 5 in which the step of selecting elongated sealing material includes selecting an elongated sealing material having an elongated polymer foam having a cover of flexible polypropylene includes selecting a covering wrapped around said elongated foamed polymer and having the elongated edges folded together and sewn to form an elongated flange.

* * * * *